US005077988A

United States Patent [19]

Pöll

[11] Patent Number: 5,077,988

[45] Date of Patent: Jan. 7, 1992

[54] METAL PLATELET COMPOUND

[75] Inventor: Martin Pöll, Fritzens, Austria

[73] Assignee: D. Swarovski & Co., Wattens, Austria

[21] Appl. No.: 552,343

[22] Filed: Jul. 16, 1990

Related U.S. Application Data

[63] Continuation of Ser. No. 365,257, Jun. 12, 1989, abandoned.

[30] Foreign Application Priority Data

Jun. 14, 1988 [DE] Fed. Rep. of Germany ..... 3820251

[51] Int. Cl.[5] ..... A44C 17/02

[52] U.S. Cl. ..... 63/26; 63/2

[58] Field of Search ..... 63/2, 3, 4, 9, 26, 28, 63/29.1

[56] References Cited

U.S. PATENT DOCUMENTS

| | | | |
|---|---|---|---|
| 761,867 | 6/1904 | Artopoens | 63/26 |
| 795,109 | 7/1905 | Dover | 63/26 |
| 1,817,519 | 8/1931 | Mandalian | 63/2 X |
| 2,920,442 | 1/1960 | Kunzmann et al. | 63/4 X |

FOREIGN PATENT DOCUMENTS

| | | | |
|---|---|---|---|
| 608150 | 7/1926 | France | 63/29.1 |
| 841565 | 7/1960 | United Kingdom | 63/26 |

*Primary Examiner*—Laurie K. Cranmer

*Attorney, Agent, or Firm*—Fay, Sharpe, Beall, Fagan, Minnich & McKee

[57] ABSTRACT

A metal platelet compound comprising adjacent circular platelets that are chained together and each have a conical depression having a hole at the apex for taking up a gem. The conical depression may also have a pouchlike extension at the apex.

9 Claims, 2 Drawing Sheets

METAL PLATELET COMPOUND

This is a continuation of copending application Ser. No. 365,257, filed on June 12, 1989, now abandoned.

The present invention relates to a metal platelet compound comprising adjacent circular platelets that are chained together.

Such a metal platelet compound is known and is used, for example, for protection in aprons and gloves in the butchery trade.

The present invention is based on the problem of providing a metal platelet compound having gems for ornamental purposes.

This problem is solved according to the invention by the following features. The platelets have a depression for taking up a gem, the gem is mounted in the depression by means of an adhesive, the depression is of conical shape, the conical depression being formed as a truncated cone having a hole at the apex.

According to the invention, it is also possible that the platelets have a depression for taking up a gem, the gem is mounted in the depression by means of an adhesive, the depression is of conical shape, the conical depression having a pouchlike extension at the apex.

Advantageously, the platelets are made of anodized aluminum or brass. However, they can also be made of lacquered metal. The gems used according to the invention are preferably cut glass gems.

Such metal platelet compounds can be provided with gems in a simple manner, it being possible to insert the gems only in certain areas of the metal platelet compound, thereby obtaining very ornamental patterns in a simple manner. The gems can be inserted into the metal platelets by hand or else with computer control.

The inventive metal platelet compound is particularly suitable for making purses, belts, articles of clothing and for application to articles of clothing.

The mounting of the gems in the depressions by means of an adhesive allows for simple attachment of the gems, the adhesive being applied either to the gems or in the depressions. Melt adhesives are preferred. Since the depression is of conical shape, it is well adapted to the conical mounting portion of the gem.

The formation of the conical depression of the metal platelet as a truncated cone having a hole at the apex prevents lacquer from collecting when the platelet is being lacquered, or adhesive from collecting when the gem is glued into the depression in the apex of the cone, which would prevent the mounting portion of the gem from adapting well to the conical depression of the metal platelet. The hole at the apex of the truncated cone also allows for a mechanical anchoring of the adhesive in the hole when it is melted, since a layer of adhesive forms around the edge of the hole.

It is also possible to give the conical depression a pouchlike extension on the apex. This creates a space for lacquer or adhesive to collect in, so that the operation of punching the metal platelet can be dispensed with but a reliable adaptation of the mounting portion of the gem to the conical depression of the metal platelet still ensured.

Exemplary embodiments of the present invention are shown in the drawing and shall be described in the following in more detail.

Figure 1:
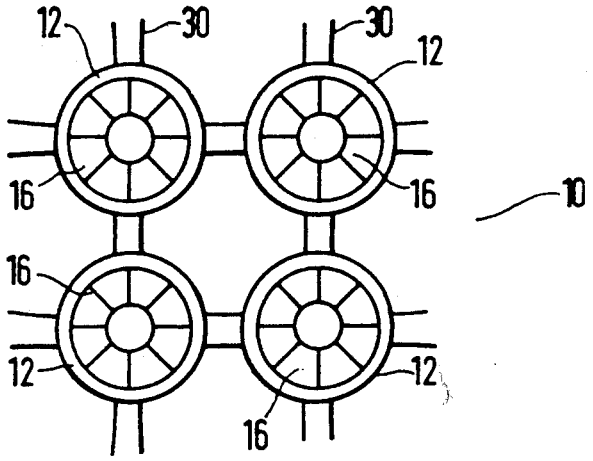
FIG. 1 shows a top view of the metal platelet compound.
Figure 2:
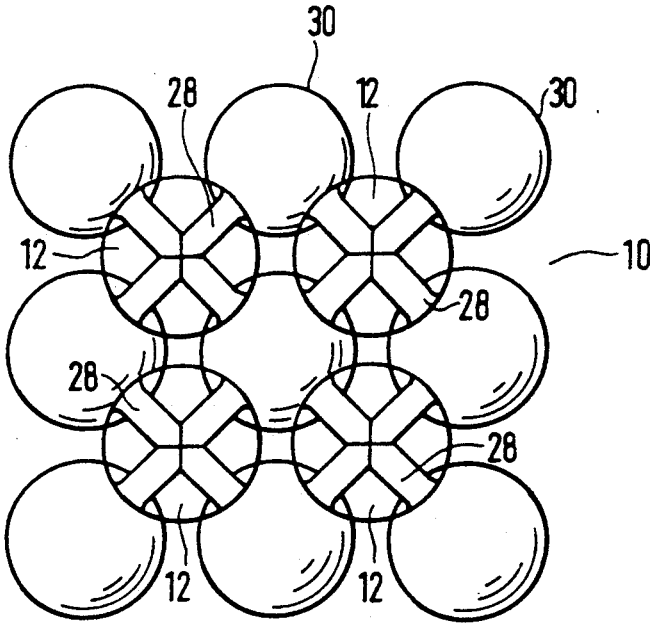
FIG. 2 shows a view of the underside of the metal platelet compound.

FIGS. 1 and 2 illustrate how metal platelets 12 are combined to form inventive metal platelet compound 10, namely in that individual metal platelets 12 are connected via rings 30. In particular FIG. 3 indicates that a metal platelet 12 has four bars 28 offset by 90° along its periphery. Each of these four bars 28 engages a ring 30 and the bending thereof, as shown in FIG. 1, brings about the chaining of individual rings 30 with metal platelets 12. The ends of bars 28 come together radially in the center on the underside of the metal platelets. Each metal platelet 12 thus engages in altogether four rings 30 and in each ring 30 altogether four metal platelets !2. By means of rings 30 one thus obtains a two-dimensional crosslinking of metal platelets 12 to form a metal platelet compound 10.

Figure 3:
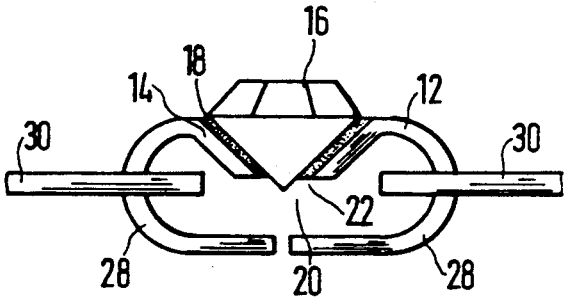
FIG. 3 shows an embodiment of a platelet of the metal platelet compound, the depression having a hole.

FIG. 3 shows an embodiment of a metal platelet 12 of metal platelet compound 10. The conical depression is open at apex 22. More precisely, a hole 20 is formed at apex 22 of the cone. This hole 20 is produced in a suitable manner in one working step during the production of metal platelets 12 with depression 14 by punching or similar methods.

Figure 4:
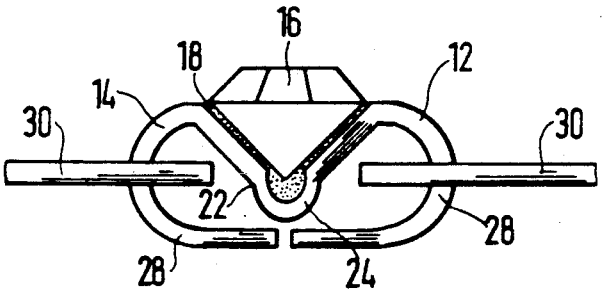
FIG. 4 shows another embodiment of a platelet of the metal platelet compound, the depression being extended at the apex.

FIG. 4 shows another embodiment of a metal platelet 12 of metal platelet compound 10. In this embodiment, apex 22 of conical depression 14 has a pouchlike extension 24. This pouchlike extension 24 can be produced in a suitable manner in one working step during the compression molding of the metal platelets.

The embodiments shown in FIGS. 3 and 4 have the advantages mentioned at the outset.

Individual metal platelets 12 and rings 30 can be made of a great variety of materials, as are used in making costume jewelry. If metal is used they can be given any desired coloring by simple lacquering. It is particularly preferred, however, to make the parts of anodized aluminum or brass.

Gems 16 can also be ones known, for example, in the costume jewelry industry. However, the gems are preferably made of cut glass.

I claim:

1. A metal platelet compound comprising adjacent platelets that are chained together, characterized in that the platelets (12) each include a conically shaped depression (14) for receiving a gem (16), wherein the gem (16) is mounted in the depression (14) by means of a layer of adhesive (18), the conical depression (14) being formed as a truncated cone having a hole (20) at the apex (22) thereof so as to allow a mechanical anchoring of the adhesive as it forms a layer around the edge of the hole.

2. A metal platelet compound according to either of claim 1 characterized in that the platelets (12) are made of anodized aluminum or brass.

3. A metal platelet compound according to either of claim 1 characterized in that the platelets (12) are made of lacquered metal.

4. A metal platelet compound according to either of claim 1 characterized in that the gems (12) are made of cut glass.

5. An ornamented metal mesh article comprising:

a plurality of platelets each of which comprises a body having a centrally disposed conically shaped depression therein and a plurality of arms extending radially away from said body;

a plurality of rings, wherein respective arms of said platelets extend through respective ones of said rings in order to interconnect said platelets and rings to form a two dimensional flexible mesh material;

a respective gem positioned in said conically shaped depression of each of said platelets; and, a layer of adhesive located between each said gem and a wall of said conical depression of each said platelet to secure said gem in said platelet body depression, wherein said adhesive layer is the only means for securing said gem to said platelet body and wherein an apex of said conically shaped depression serves as a means for disposing of excess adhesive.

6. The article of claim 5 wherein said apex of said conically shaped depression is truncated to form a hole which allows a mechanical anchoring of the adhesive as it forms a layer around an edge of said hole.

7. The article of claim 5 wherein said apex of said conically shaped depression is provided with a pouch-like extension for holding any excess adhesive.

8. The article of claim 5 wherein said plurality of arms comprises four arms which are oriented at approximately right angles to each other.

9. The article of claim 8 wherein said platelets and said rings are each substantially circular in plan view.

* * * * *